US010867727B2

(12) United States Patent
Dong et al.

(10) Patent No.: US 10,867,727 B2
(45) Date of Patent: Dec. 15, 2020

(54) RARE EARTH PERMANENT MAGNET MATERIAL AND MANUFACTURING METHOD THEREOF

(71) Applicant: Baotou Tianhe Magnetics Technology Co., Ltd., Baotou (CN)

(72) Inventors: Yi Dong, Baotou (CN); Shulin Diao, Baotou (CN); Haibo Yi, Baotou (CN); Shujie Wu, Baotou (CN); Zhanjiang Hu, Baotou (CN); Qian Zhang, Baotou (CN); Gazhen Liu, Baotou (CN); Juchang Miao, Baotou (CN); Yi Yuan, Baotou (CN); Ya Chen, Baotou (CN); Wenjie Yuan, Baotou (CN)

(73) Assignee: Baotou Tianhe Magnetics Technology Co., Ltd.

( * ) Notice: Subject to any disclaimer, the term of this patent is extended or adjusted under 35 U.S.C. 154(b) by 785 days.

(21) Appl. No.: 15/060,123

(22) Filed: Mar. 3, 2016

(65) Prior Publication Data

US 2017/0062105 A1 Mar. 2, 2017

(30) Foreign Application Priority Data

Aug. 28, 2015 (CN) ..... 2015 1 0546132

(51) Int. Cl.

| | |
|---|---|
| ***H01F 1/057*** | (2006.01) |
| ***H01F 41/02*** | (2006.01) |
| ***B22F 3/24*** | (2006.01) |
| ***B22F 9/02*** | (2006.01) |
| ***B22F 9/04*** | (2006.01) |

(52) U.S. Cl.

CPC ..... *H01F 1/0577* (2013.01); *B22F 3/24* (2013.01); *B22F 9/023* (2013.01); *B22F 9/04* (2013.01); *H01F 41/0293* (2013.01); *B22F 2003/248* (2013.01); *B22F 2009/044* (2013.01)

(58) Field of Classification Search

CPC ..... H01F 1/0577; H01F 41/0293; B22F 3/24; B22F 9/023; B22F 9/04; B22F 2003/248; B22F 2009/044

See application file for complete search history.

(56) References Cited

U.S. PATENT DOCUMENTS 4,853,045 A * 8/1989 Rozendaal ..... H01F 1/0573 148/103
7,402,226 B2 * 7/2008 Machida ..... C23C 14/3464 204/192.2
8,206,516 B2 * 6/2012 Yoshimura ..... B22F 7/062 148/101
2009/0020193 A1 1/2009 Ohta et al.
2013/0049908 A1 * 2/2013 Yuan ..... H01F 41/0266 335/302
2013/0266472 A1 * 10/2013 Wang ..... C23C 16/08 419/35
2014/0334962 A1 * 11/2014 Sun ..... B02C 19/06 419/28
2014/0352847 A1 * 12/2014 Yu ..... B22F 3/26 148/104
2015/0194259 A1 7/2015 Sun et al.
2016/0122864 A1 5/2016 Peng et al.

FOREIGN PATENT DOCUMENTS

| | | | | |
|---|---|---|---|---|
| CN | 101006534 | A | | 7/2007 |
| CN | 101404195 | A | | 4/2009 |
| CN | 101506919 | A | | 8/2009 |
| CN | 101615459 | A | | 12/2009 |
| CN | 102031522 | A | | 4/2011 |
| CN | 103258633 | A | | 8/2013 |
| CN | 103646772 | A | | 3/2014 |
| CN | 102936677 | B | * | 5/2014 |
| CN | 103820765 | A | | 5/2014 |
| CN | 103824693 | A | | 5/2014 |
| CN | 104018133 | A | | 9/2014 |
| CN | 104064346 | A | * | 9/2014 |

(Continued)

OTHER PUBLICATIONS

Machine Translation of JP-2009049378-A (Year: 2009).*
Machine translation of CN-102936677-B (Year: 2014).*
Machine Translation of CN-104064346-A (Year: 2014).*
Google Patents Machine Translation of CN-104064346-A (Year: 2014).*
Mattox, Donald M. Handbook of Physical Vapor Deposition (PVD) Processing. Elsevier, 2010 (Year: 2010).*
Bouzakis KD., Michailidis N. (2018) Physical Vapor Deposition (PVD). In: Int. Academy for Production Engineering, Chatti S., Tolio T. (eds) CIRP Encyclopedia of Production Engineering. Springer, Berlin, Heidelberg (Year: 2018).*
Search Report from Chinese Office Action for Application No. 2015105461329 dated Oct. 27, 2016; 3 pages.

(Continued)

*Primary Examiner* — Paul A Wartalowicz
*Assistant Examiner* — Ryan L Heckman
(74) *Attorney, Agent, or Firm* — Lerner, David, Littenberg, Krumholz & Mentlik, LLP

(57) ABSTRACT

The present invention provides a rare earth permanent magnet material and manufacturing method thereof. The manufacturing method of the present invention comprises a multi-arc ion plating step and a infiltrating step, wherein multi-arc ion plating process is adopted to deposit a metal containing a heavy rare earth element on a surface of a sintered neodymium-iron-boron magnet which has a thickness of 10 mm or less in at least one direction; and then heat treatment is performed on the sintered neodymium-iron-boron after deposition. The sum of an intrinsic coercive force ($H_{cj}$, in unit of kOe) and a maximum magnetic energy product ($(BH)_{max}$, in unit of MGOe) of the permanent magnet material of the present invention is 66.8 or more. Moreover, the manufacturing method of the present invention has high production efficiency and does not increase harmful substances, and the price of devices is relatively low.

1 Claim, No Drawings

(56) References Cited

FOREIGN PATENT DOCUMENTS

| | | | | |
|---|---|---|---|---|
| CN | 104480440 | A | | 4/2015 |
| CN | 104651783 | A | | 5/2015 |
| JP | H0995763 | A | | 4/1997 |
| JP | 2009049378 | A | * | 3/2009 |

OTHER PUBLICATIONS

Search Report from Chinese Office Action for 201519546132.9 dated Feb. 23, 2017; 2 pages.

Tang, Dunyi, "Multi-arc Ion Plating," Technology and Application of High Current Charged Particle Beam, Apr. 30, 1995, pp. 1-6; English Abstract only available.

* cited by examiner

RARE EARTH PERMANENT MAGNET MATERIAL AND MANUFACTURING METHOD THEREOF

CROSS REFERENCE TO RELATED APPLICATIONS

The present application claims priority from Chinese Patent Application No. 201510546132.9, filed Aug. 28, 2015, the disclosure of which is incorporated herein by reference.

TECHNICAL FIELD OF THE INVENTION

The present invention relates to a rare earth permanent magnet material and manufacturing method thereof, in particular to a sintered neodymium-iron-boron rare earth permanent magnet material and manufacturing method thereof.

BACKGROUND OF THE INVENTION

As the attention to reduction of energy consumption is increasing worldwide, energy saving and emission reduction have become the focus of each country. Compared with non-permanent magnet motors, permanent magnet motors can increase energy efficiency ratio. Therefore, in order to reduce energy consumption, neodymium-iron-boron (Nd—Fe—B) permanent magnet material is used to produce electric motors in various fields, such as air condition compressors, electric vehicles, hybrid vehicles. Since the operation temperature of these electric motors is relatively high, the magnets are required to have a relatively high intrinsic coercive force ($H_{cj}$); in addition, in order to increase the magnetic flux density of the motors, the magnets are also required to have a relatively high magnetic energy product (BH).

Conventional neodymium-iron-boron manufacturing process is difficult to meet the requirements of high magnetic energy product and high intrinsic coercive force. Even such requirements are met; a large amount of heavy rare earth of Dysprosium (Dy) and Terbium (Tb) is also demanded. Because the worldwide reserves of Dy and Tb are limit, using a large amount of Dy and Tb will lead to a price increase of magnets and an accelerated exhaustion of the heavy rare earth resource.

In order to improve the performance of permanent magnet material and to reduce the use of heavy rare earth, a lot of work has been done in the field. For example, CN101404195A discloses a method for preparing a rare earth permanent magnet, comprising: providing a sintered magnet body consisting of 12-17 atom % of a rare earth, 3-15 atom % of B, 0.01-11 atom % of a metal element, 0.1-4 atom % of O, 0.05-3 atom % of C, 0.01-1 atom % of N, and the balance of Fe, disposing on a surface of the magnet body a powder comprising an oxide, fluoride and/or oxyfluoride of another rare earth, and heat treating the powder-covered magnet body at a temperature not higher than the sintering temperature in vacuum or in an inert gas so that the other rare earth is absorbed in the magnet body. This method is characterized in that the object of infiltration is achieved by heat treating the magnet whose surface is disposed with oxide, fluoride and/or oxyfluoride of the heavy rare earth; while the disadvantage thereof is the introduction of O and F which are harmful substances to magnets. More importantly, the surface of the magnet where infiltration is completed will have more substances which are similar to oxide skin, and needs grinding, resulting in a waste of magnetic material.

CN101506919A discloses a method for manufacturing a permanent magnet which can effectively improve the magnetizing properties and coercive force by efficiently diffusing Dy into grain boundary phases without deteriorating a surface of a Nd—Fe—B-based sintered magnet and does not require any subsequent working process. In this method, the Nd—Fe—B-based sintered magnet and Dy are arranged apart from each other at a certain distance in a processing chamber. Then the processing chamber is heated under a reduced pressure to evaporate Dy while elevating the temperature of the sintered magnet to a predetermined temperature and to supply and deposit the evaporated Dy atoms onto the surface of the sintered magnet; during this operation, the supplying amount of Dy atoms onto the sintered magnet is controlled so as to diffuse and homogeneously infiltrate them into the grain boundary phases of the sintered magnet before a Dy layer is formed on the surface of the sintered magnet. This method is characterized in heating a substance containing a heavy rare earth to form steam; while the disadvantage thereof is that the cost of expensive equipments, low evaporation efficiency. The results of actual comparison show that this method is inferior to the former method in the effect of increasing $H_{cj}$.

CN101615459A discloses a method for improving properties of a sintered neodymium-iron-boron permanent magnet by diffusing a heavy rare earth compound in grain boundary of a rapid-hardening flake, in which an infiltration treatment is performed before sintering. The disadvantage thereof is that during the high temperature sintering process of the infiltrated magnet, the heavy rare earth which has been enriched in an intergranular phase will diffuse to the interior of the main phase, causing heavy rare earth averaging, so the effect is worse.

On the other hand, plating a metal coating on the surface of a neodymium-iron-boron magnet has been disclosed in much prior art. In these prior art, multi-arc ion plating process is an important process of plating a metal coating on the surface of the neodymium-iron-boron magnet.

For example, CN104018133A discloses a process for preparing a multilayer composite protective coating on the surface of a sintered neodymium-iron-boron magnet by multi-arc ion plating, in which by adopting the multi-arc ion plating technology, a composite protective coating consisting of a transition layer, a corrosion-resistant layer, a surface barrier layer and a wear-resistant layer is prepared on the surface of the sintered neodymium-iron-boron magnet, the corrosion resistance of the sintered neodymium-iron-boron magnet is obviously improved. CN104651783A discloses a process for plating aluminum on the surface of a permanent magnet neodymium-iron-boron magnetic steel, in which multi-arc ion plating is adopted to plate aluminum, and the permanent magnet neodymium-iron-boron magnetic steel in which aluminum plating has been completed is subjected to passivating treatment, so that the surface plated aluminum which has a fine surface and good corrosion prevention can be obtained. CN102031522A discloses a method for preparing a neodymium-iron-boron magnet coated with an aluminum or aluminum alloy composite coating, in which multi-arc ion plating technology is adopted to deposit an aluminum or aluminum alloy film on the neodymium-iron-boron magnet, and then phosphating treatment is performed; the prepared composite coating has good corrosion resistance and good adhesion performance, and has no influence on the magnetism of the neodymium-iron-boron matrix.

However, none of these prior art disclose or teach plating an elementary substance or an alloy containing a heavy rare earth element on the surface of a sintered neodymium-iron-boron magnet by adopting multi-arc ion plating. Moreover, the object of these prior art is only to provide a corrosion resistant coating for the surface of the sintered neodymium-iron-boron magnet. None of these prior art disclose or teach infiltrating the heavy rare earth element plated on the surface of the sintered neodymium-iron-boron magnet to the intergranular phase in the sintered neodymium-iron-boron magnet, so as to improve magnetic parameters of the sintered neodymium-iron-boron magnet.

SUMMARY OF THE INVENTION

An object of the present invention is to provide a rare earth permanent magnet material having a sum of an intrinsic coercive force ($H_{cj}$, in unit of kOe) and a maximum magnetic energy product ($(BH)_{max}$, in unit of MGOe) of 66.8 or more. A further object of the present invention is to provide a method for manufacturing a rare earth permanent magnet material, which has high production efficiency and does not increase harmful substances, and the cost of equipments is relatively low.

The present invention provides a rare earth permanent magnet material, said rare earth permanent magnet material fulfills a formula as follows:

$$H_{cj}+(BH)_{max}\geq 66.8,$$

wherein, $H_{cj}$ represents an intrinsic coercive force of the permanent magnet material with a unit of kOe;

$(BH)_{max}$ represents a maximum magnetic energy product of the permanent magnet material with a unit of MGOe.

The present invention also provides a method for manufacturing the above mentioned rare earth permanent magnet material, comprising steps as follows:

S2) multi-arc ion plating step: a multi-arc ion plating process is adopted to deposit a metal containing a heavy rare earth element on the surface of a sintered neodymium-iron-boron magnet, wherein the sintered neodymium-iron-boron magnet has a thickness of no more than 10 mm in at least one direction; and S3) infiltrating step: heat treating the sintered neodymium-iron-boron magnet obtained from the multi-arc ion plating step S2);

wherein, the multi-arc ion plating step S2) is carried out in a vacuum closed space, and an absolute vacuum degree of the closed space is 0.00001-0.001 Pa.

In accordance with the manufacturing method of the present invention, preferably, in the multi-arc ion plating step S2), the metal containing a heavy rare earth element is selected from an elementary substance of a heavy rare earth element or an alloy containing a heavy rare earth element, wherein the heavy rare earth element is at least one selected from Gadolinium, Terbium, Dysprosium and Holmium.

In accordance with the manufacturing method of the present invention, preferably, in the multi-arc ion plating step S2), the metal containing a heavy rare earth element is used as a cathode material; discharging is performed by applying a voltage by a multi-arc ion discharging device; during the discharging, the cathode material evaporates to form smoke-like microparticles which deposit on the surface of the sintered neodymium-iron-boron magnet, wherein the time of applying voltage is 1-30 min.

In accordance with the manufacturing method of the present invention, preferably, the infiltrating step S3) is carried out simultaneously with the multi-arc ion plating step S2), or the infiltrating step S3) is carried out after the multi-arc ion plating step S2).

In accordance with the manufacturing method of the present invention, preferably, in the infiltrating step S3), the heat treatment temperature is 700-1100° C.

In accordance with the manufacturing method of the present invention, preferably, the manufacturing method further comprises steps as follows:

S1) magnet manufacturing step: manufacturing a sintered neodymium-iron-boron magnet; and S4) aging treatment step: aging treatment is performed on the sintered neodymium-iron-boron magnet.

In accordance with the manufacturing method of the present invention, preferably, aging treatment is not performed in the magnet manufacturing step S1).

In accordance with the manufacturing method of the present invention, preferably, the magnet manufacturing step S1) comprises steps as follows:

S1-1) smelting step: smelting a neodymium-iron-boron magnet raw material so that the smelted neodymium-iron-boron magnet raw material forms a master alloy which has a thickness of 0.01-2 mm;

S1-2) powdering step: crushing the master alloy obtained from the smelting step S1-1) into magnetic powder, the magnetic powder having an average particle size D50 of no more than 20 μm;

S1-3) shaping step: pressing the magnetic powder obtained from the powdering step S1-2) into a green body for sintering under the action of an alignment magnetic field; and S1-4) sintering step: sintering the green body obtained from the shaping step S1-3) into a sintered neodymium-iron-boron magnet; a sintering temperature is 900-1200° C.; the oxygen content of the sintered neodymium-iron-boron magnet is less than 2000 ppm.

In accordance with the manufacturing method of the present invention, preferably, in the aging treatment step S4), temperature of the aging treatment is 300-800° C.

The present invention adopts the multi-arc ion plating process to deposit the metal containing a heavy rare earth element on the surface of the sintered neodymium-iron-boron magnet; the heavy rare earth element is melt and infiltrated to the intergranular phase in the sintered neodymium-iron-boron magnet through heat treatment; and then a neodymium-iron-boron permanent magnet material is manufactured through aging treatment. The neodymium-iron-boron permanent magnet material obtained by the manufacturing method of the present invention has a sum of an intrinsic coercive force ($H_{cj}$, in unit of kOe) and a maximum magnetic energy product ($(BH)_{max}$, in unit of MGOe) of 66.8 or more. In accordance with a preferable technical solution of the present invention, because multi-arc ion plating process is adopted, the manufacturing method of the present invention has high production efficiency and does not increase harmful substances, and the cost of equipments is relatively low. According to a further preferable technical solution of the present invention, the aging treatment is omitted during the manufacturing steps of the sintered neodymium-iron-boron magnet, the production cost is saved.

DETAILED DESCRIPTION OF EMBODIMENTS

The present invention will be further described hereinafter in combination with the following specific embodiments, but the protection scope of the invention is not limited thereto.

The "remanence" in the present invention refers to a value of the magnetic flux density at a point on the saturant magnetic hysteresis loop where the magnetic field strength is zero, and is commonly referred to as $B_r$ or $M_r$, with the unit of Tesla (T) or Gauss (Gs).

The "intrinsic coercive force" in the present invention refers to the magnetic field strength when the magnetic field is monotonically decreased to zero from the saturant magnetization state of the magnet and reversely increased to make its magnetization strength decrease to zero along the saturant magnetic hysteresis loop, and is commonly referred to as $H_{cj}$ or ${}_MH_c$, with the unit of Oersted (Oe).

The "magnetic energy product" in the present invention refers to the product of the magnetic flux density (B) of any point on the demagnetization curve and the corresponding magnetic field strength (H), and is commonly referred to as BH. The maximum value of BH is referred to as "maximum magnetic energy product" which is commonly referred to as $(BH)_{max}$, with the unit of Gauss·Oersted (GOe).

The "heavy rare earth element" in the present invention is also referred to as "Yttrium-group element", including nine elements of Yttrium (Y), Gadolinium (Gd), Terbium (Tb), Dysprosium (Dy), Holmium (Ho), Erbium (Er), Thulium (Tm), Ytterbium (Yb), and Lutetium (Lu).

The "inert atmosphere" in the present invention refers to the atmosphere which does not react with the neodymium-iron-boron magnet and not affect its magnetism. In the present invention, the "inert atmosphere" includes an atmosphere consisting of nitrogen or inert gases (helium, neon, argon, krypton, xenon).

The "vacuum" in the present invention means that an absolute vacuum degree is less than or equal to 0.1 Pa, preferably, is less than or equal to 0.01 Pa, more preferably, is less than or equal to 0.001 Pa. In the present invention, a smaller value of the absolute vacuum degree represents a higher vacuum degree.

The "average particle size D50" in the present invention represents the equivalent diameter of the largest particles when the cumulative distribution in the particle size distribution curve is 50%.

<Rare Earth Permanent Magnet Material>

The rare earth permanent magnet material of the present invention fulfills a formula: $H_{cj}+(BH)_{max}\geq 66.8$; wherein, $H_{cj}$ represents the intrinsic coercive force of the permanent magnet material with the unit of kOe; $(BH)_{max}$ represents the maximum magnetic energy product of the permanent magnet material with the unit of MGOe. Preferably, $H_{cj}+(BH)_{max}\geq 67$; preferably, $H_{cj}+(BH)_{max}\geq 68.5$; more preferably, $H_{cj}+(BH)_{max}\geq 70$; most preferably, $H_{cj}+(BH)_{max}\geq 72$.

<Manufacturing Method of Rare Earth Permanent Magnet Material>

The manufacturing method of the permanent magnet material of the present invention comprises a multi-arc ion plating step S2) and a infiltrating step S3). Preferably, The manufacturing method of the present invention further comprises a magnet manufacturing step S1) and an aging treatment step S4).

<Magnet Manufacturing Step S1)>

The manufacturing method of the present invention preferably comprises a magnet manufacturing step S1): manufacturing a sintered neodymium-iron-boron magnet. In the present invention, the magnet manufacturing step S1) preferably comprises steps as follows:

S1-1) smelting step: smelting a neodymium-iron-boron magnet raw material so that the smelted neodymium-iron-boron magnet raw material forms a master alloy;

S1-2) powdering step: crushing the master alloy obtained from the smelting step S1-1) into magnetic powder;

S1-3) shaping step: pressing the magnetic powder obtained from the powdering step S1-2) into a green body for sintering under the action of an alignment magnetic field; and S1-4) sintering step: sintering to shape the green body obtained from the shaping step S1-3) into a sintered neodymium-iron-boron magnet.

In accordance with a preferable embodiment of the present invention, the magnet manufacturing step S1) may further comprise steps as follows:

S1-5) tempering treatment step: tempering the sintered neodymium-iron-boron magnet; and/or S1-6) cutting step: cutting the sintered neodymium-iron-boron magnet.

Smelting Step S1-1)

In order to prevent the oxidation of the neodymium-iron-boron magnet raw material and the master alloy prepared therefrom, the smelting step S1-1) of the present invention is preferably carried out in vacuum or inert atmosphere. In the smelting step S1-1), there is no particular limit on the neodymium-iron-boron magnet raw material or the ratio thereof, and those raw materials and the ratio thereof which are well known in this field may be adopted. In the smelting step S1-1) of the present invention, smelting process preferably adopts an ingot casting process or a strip casting process. The ingot casting process is that the smelted neodymium-iron-boron magnet raw material is cooled and solidified and is made into an alloy ingot (master alloy). The strip casting process is that the smelted neodymium-iron-boron magnet raw material is rapidly cooled and solidified and is spined into an alloy sheet (master alloy). In accordance with a preferable embodiment of the present invention, the smelting process adopts the strip casting process. The inventor of this application has surprisingly found that as compared with the ingot casting process, the strip casting process can avoid the appearance of α-Fe which affects the homogeneousness of magnetic powder, and can avoid the appearance of neodymium-rich phase in lump shape, so that it is advantageous for refining the grain size of a main phase $Nd_2Fe_{14}B$ of the master alloy. The strip casting process of the present invention is preferably performed in a vacuum smelting and rapid-hardening furnace. The alloy sheet (master alloy) of the present invention may have a thickness of 0.01-2 mm, preferably 0.05-1 mm, more preferably 0.1-0.5 mm.

Powdering Step S1-2)

In order to prevent the oxidation of the master alloy and the magnetic powder crushed therefrom, the powdering step S1-2) of the present invention is preferably carried out in vacuum or inert atmosphere. The powdering process S1-2) of the present invention preferably comprises steps as follows:

S1-2-1) coarsely crushing step: crushing the master alloy into coarse magnetic powder with a larger particle size; and S1-2-2) milling step: milling the coarse magnetic powder obtained from the coarsely crushing step S1-2-1) into fine magnetic powder.

In the present invention, the average particle size D50 of the coarse magnetic powder obtained from the coarsely crushing step S1-2-1) may be 500 μm or less, preferably 300 μm or less, more preferably 100 μm or less. In the present invention, the average particle size D50 of the fine magnetic powder obtained from the milling step S1-2-2) may be 20 μm or less, preferably 10 μm or less, more preferably 4.5 μm or less.

In the coarsely crushing step S1-2-1) of the present invention, a mechanical crushing process and/or a hydrogen decrepitation process adopted to crush the master alloy into coarse magnetic powder. The mechanical crushing process is a process to crush the master alloy into coarse magnetic powder using a mechanical crushing device. The mechanical crushing device may be selected from a jaw crusher or a hammer crusher. The hydrogen decrepitation process comprises steps as follows: firstly making the master alloy absorb hydrogen, initializing a volume expansion of the master alloy crystal lattice through the reaction of the master alloy and hydrogen so that the master alloy breaks into coarse magnetic powder; and then heating the coarse magnetic powder to perform dehydrogenation. In accordance with a preferably embodiment of the present invention, the hydrogen decrepitation process of the present invention is preferably carried out in a hydrogen decrepitation furnace. In the hydrogen decrepitation process of the present invention, the hydrogen absorption temperature is 20° C.-400° C., preferably 100° C.-300° C.; and the hydrogen absorption pressure is 50-600 kPa, preferably 100-500 kPa; and the dehydrogenation temperature is 500-1000° C., preferably 700-900° C.

In the milling step S1-2-2) of the present invention, a ball milling process and/or a jet milling process is adopted to crush the coarse magnetic powder into fine magnetic powder. The ball milling process is a process to crush the coarse magnetic powder into fine magnetic powder using a mechanical ball milling device. The mechanical ball milling device may be selected from a rolling ball mill, a vibration ball mill or a high energy ball mill. The jet milling process is a process to make the coarse magnetic powder accelerated and hit each other and then crushed by using a gas flow. The gas flow may be nitrogen flow, preferably high purity nitrogen flow. The high purity nitrogen flow may have $N_2$ content of 99.0 wt % or more, preferably 99.9 wt % or more. The pressure of the gas flow may be 0.1-2.0 MPa, preferably 0.5-1.0 MPa, more preferably 0.6-0.7 MPa.

In accordance with a preferable embodiment of the present invention, the powdering process S1-2) comprises the following steps: firstly, crushing the master alloy into coarse magnetic powder by the hydrogen decrepitation process; and then, crushing the coarse magnetic powder into fine magnetic powder by the jet milling process.

Shaping Step S1-3)

In order to prevent oxidation of the magnetic powder, the shaping step S1-3) of the present invention is preferably carried out in vacuum or inert atmosphere. The magnetic powder pressing process of the present invention is preferably a mould pressing process and/or an isostatic pressing process. The mould pressing process and the isostatic pressing process can be those well known in this field, which will be not repeated herein. In the shaping step S1-3) of the present invention, the direction of alignment magnetic field is aligned parallel or perpendicular to the pressing direction of the magnetic powder. There is no specific limitation on the strength of the alignment magnetic field which depends on practical desires. In accordance with a preferable embodiment of the present invention, the strength of the alignment magnetic field is at least 1 Tesla (T), preferably more than or equal to 1.4 T, more preferably more than or equal to 1.8 T. The density of the green body obtained from the shaping step S1-3) of the present invention may be 3.0 g/cm$^3$-5 g/cm$^3$, preferably 3.5 g/cm$^3$-4.5 g/cm$^3$.

Sintering Step S1-4)

In order to prevent oxidation of the green body for sintering, the sintering step S1-4) of the present invention is preferably carried out in vacuum or inert atmosphere. In accordance with the preferable embodiment of the present invention, the sintering step S1-4) is carried out in a vacuum sintering furnace. The sintering temperature may be 900-1200° C., preferably 1030-1080° C.; the sintering time may be 0.5-10 hours, preferably 1-6 hours. The density of the sintered neodymium-iron-boron magnet obtained from the sintering step S1-4) of the present invention may be 6.0 g/cm$^3$-9.0 g/cm$^3$, preferably 6.5 g/cm$^3$-8.0 g/cm$^3$; the oxygen content is preferably less than 2000 ppm, more preferably less than 1500 ppm, most preferably less than 1200 ppm.

Tempering treatment step S1-5)

In the tempering treatment step S1-5) of the present invention, the temperature of the tempering treatment is preferably 400-1000° C., more preferably 500-900° C.; the time of the tempering treatment is preferably 0.5-10 hours, more preferably 1-6 hours.

Cutting Step S1-6)

In the cutting step S1-6) of the present invention, the cutting process adopts a slicing process and/or a wire cut electrical discharge machining. In the present invention, the sintered neodymium-iron-boron magnet is cut into magnets with a thickness of 10 mm or less, preferably 5 mm or less in at least one direction. Preferably, the direction in which the thickness is 10 mm or less, preferably 5 mm or less is not the alignment direction of the sintered neodymium-iron-boron magnet.

In the present invention, the magnet manufacturing step S1) is preferably carried out before the plating step S2). To save the cost, it is preferable not to perform an aging treatment in the magnet manufacturing step S1).

<Multi-Arc Ion Plating Step S2>

The manufacturing method of the present invention comprises a multi-arc ion plating step S2): a multi-arc ion plating process is adopted to deposit a metal containing a heavy rare earth element on the surface of the sintered neodymium-iron-boron magnet, wherein the sintered neodymium-iron-boron magnet has a thickness of 10 mm or less in at least one direction. Preferably, the direction in which the thickness is 10 mm or less is not the alignment direction of the sintered neodymium-iron-boron magnet.

The metal containing a heavy rare earth element of the present invention is selected from an elementary substance of a heavy rare earth element or an alloy containing a heavy rare earth element. The alloy containing a heavy rare earth element of the present invention further contains other metal element(s) in addition to the heavy rare earth element. Said other metal element(s) is preferably at least one of aluminum, gallium, magnesium, tin, silver, copper and zinc. In the metal containing a heavy rare earth element of the present invention, the heavy rare earth element is selected from yttrium group elements, for example at least one selected from yttrium, gadolinium, terbium, dysprosium, holmium, erbium, thulium, ytterbium and lutetium. In accordance with a preferable embodiment of the present invention, the heavy rare earth element is at least one of gadolinium, terbium, dysprosium and holmium.

The multi-arc ion plating step S2) of the present invention adopts a multi-arc ion plating process. In order to prevent oxidation of the sintered neodymium-iron-boron magnet, the multi-arc ion plating step S2) is preferably carried out in vacuum or inert atmosphere. In accordance with a preferable embodiment of the present invention, the multi-arc ion plating step S2) is carried out in a closed space in vacuum. The absolute vacuum degree of the closed space may be 0.00001-0.001 Pa, preferably 0.0001-0.0005 Pa, more preferably 0.0003-0.0005 Pa. In the multi-arc ion plating process of the present invention, the metal containing a heavy rare earth element is used as a cathode material; discharging is performed by applying a voltage by a multi-arc ion discharging device; during the discharging, the cathode material evaporates to form smoke-like microparticles which deposit on the surface of the sintered neodymium-iron-boron magnet. The multi-arc ion discharging device used by the present invention may be those known in this field, which normally comprises a processing chamber, a substrate (a sintered neodymium-iron-boron magnet), an anode, a cathode (a metal containing a heavy rare earth element), magnetic field and an arc power supply, wherein the processing chamber is earthed or is applied with a bias voltage of −50 to −1000V, preferably −100 to −800V as the anode; the metal containing a heavy rare earth element is used as the cathode; the substrate (the sintered neodymium-iron-boron magnet) is placed in the processing chamber; after the arc power supply is turned on, arc discharging occurs between the cathode (the metal containing a heavy rare earth element) and the anode, leading to evaporation and ionization of the cathode material, to inject a molten cathode material which is deposited on the surface of the substrate (the sintered neodymium-iron-boron magnet). In the multi-arc ion plating process of the present invention, the purity of the metal containing a heavy rare earth element which is used as the cathode is preferably 99.0% or more, more preferably 99.9% or more, most preferably 99.99% or more. In the multi-arc ion plating process of the present invention, the time of applying voltage in the multi-arc ion discharging device is preferably 1-30 min, more preferably 2-15 min. The discharging voltage of the multi-arc ion discharging device of the present invention may be 80-250 V, preferably 100-150 V, more preferably 110-120 V.

<Infiltrating Step S3)>

The manufacturing method of the present invention comprises an infiltrating step (i.e., diffusion step) S3): heat treating the sintered neodymium-iron-boron magnet obtained from the multi-arc ion plating step S2).

The object of performing heat treatment in the present invention is to infiltrate the heavy rare earth element deposited on the surface of the sintered neodymium-iron-boron magnet to the intergranular phase in the sintered neodymium-iron-boron magnet. The temperature of heat treatment may be 600-1100° C., preferably 700-1000° C.; the time of heat treatment is 0.5-10 hours, preferably 2-6 hours. In order to prevent oxidation of the surface of sintered neodymium-iron-boron magnet during the heat treatment and further prohibit continuous infiltration of the heavy rare earth element, the infiltrating step S3) of the present invention is preferably carried out in vacuum or inert atmosphere. The absolute vacuum degree of the infiltrating step S3) may be 0.0001-0.1 Pa, preferably 0.0002-0.01 Pa, more preferably 0.0005-0.001 Pa.

In accordance with a preferable embodiment of the present invention, the infiltrating step S3) is carried out simultaneously with the multi-arc ion plating step S2), or the infiltrating step S3) is carried out after the multi-arc ion plating step S2).

<Aging Treatment Step S4)>

The manufacturing method of the present invention preferably comprises an aging treatment step S4): aging treatment is performed on the sintered neodymium-iron-boron magnet.

In order to prevent oxidation of the sintered neodymium-iron-boron magnet, the aging treatment step S4) of the present invention is preferably carried out in vacuum or inert atmosphere. In the present invention, the temperature of the aging treatment may be 300-800° C., preferably 400-600° C.; the time of the aging treatment may be 0.5-10 hours, preferably 1-8 hours.

In accordance with a preferable embodiment of the present invention, the aging treatment step S4) is carried out after the infiltrating step S3).

In the following examples and comparative examples, the discharging voltage of the multi-arc ion discharging device is 120V.

Example 1 and Comparative Example 1

A method for manufacturing a permanent magnet material is as follows:

S1) Magnet Manufacturing Step:

S1-1) smelting step: formulating the raw materials according to weight percentages as follows: 23.5% of Nd, 5.5% of Pr, 2% of Dy, 1% of B, 1% of Co, 0.1% of Cu, 0.08% of Zr, 0.1% of Ga and the balance of Fe; putting the raw materials in a vacuum smelting and rapid-hardening furnace to smelt them and manufacture an alloy sheet with an average thickness of 0.3 mm;

S1-2) powdering step: subjecting the alloy sheet obtained from the smelting step S1-1) to hydrogen absorption and dehydrogenation in a hydrogen decrepitation furnace to make the alloy sheet form coarse magnetic powder of about 300 μm; milling the coarse magnetic powder in a jet milling with nitrogen as a media into fine magnetic powder with an average particle size D50 of 4.2 μm;

S1-3) shaping step: applying an alignment magnetic field strength of 1.8 T to shape the fine magnetic powder obtained from the powdering step S1-2) in a moulding press under protection of nitrogen to form a green body for sintering, the green body has a density of 4.3 g/cm$^3$;

S1-4) sintering step: putting the green body obtained from the shaping step S1-3) in a vacuum sintering furnace with an absolute vacuum degree above 0.1 Pa, and sintering it at a high temperature of 1050° C. for 5 hours, to obtain a sintered neodymium-iron-boron magnet with a density of 7.6 g/cm$^3$ and a size of 50 mm×40 mm×30 mm;

S1-5) cutting process: cutting the sintered neodymium-iron-boron magnet obtained from the sintering step S1-4) into magnets with a size of 38 mm×23.5 mm×4 mm;

S2) multi-arc ion plating step: fixing a Tb metal block material on a multi-arc ion discharging device; and placing the sintered neodymium-iron-boron magnet obtained from the cutting process S1-5) which needs infiltration in a processing chamber; the processing chamber is vacuumed to an absolute vacuum degree of 0.0003 Pa; discharging is performed by applying a voltage to the multi-arc ion discharging device, so that the Tb metal block material forms smoke-like microparticles during discharging; the time of applying voltage is 2 min, 5 min, 10 min, respectively;

S3) infiltrating step: heat treating the sintered neodymium-iron-boron magnet at 900° C. for 5 hours simultaneously with the multi-arc ion plating step S2);

S4) aging treatment step: in a condition of an absolute vacuum degree above 0.01 Pa, performing the aging treatment on the sintered neodymium-iron-boron magnet obtained from the infiltrating step S3) at 500° C. for 3 hours, to obtain the neodymium-iron-boron permanent magnet material of the present invention.

Then the neodymium-iron-boron permanent magnet material obtained from the aging treatment step S4) is cut into magnets with a size of 9 mm×9 mm×4 mm and measured.

For a comparison, the aging treatment is performed on the sintered neodymium-iron-boron magnet obtained from the magnet manufacturing step S1) in vacuum at 500° C. for 3 hours; then, the magnet is processed into magnets with a size of 9 mm×9 mm×4 mm and measured, referred to as Comparative example 1.

Magnetic parameters of Example 1 and Comparative example 1 are shown as in Table 1.

TABLE 1

| | Conditions | $B_r$ (kGs) | $(BH)_{max}$ (MGOe) | $H_{cj}$ (kOe) | $H_{cj} + (BH)_{max}$ |
|---|---|---|---|---|---|
| comparative example 1 | Non-infiltration | 13.82 | 45.85 | 18.25 | 64.1 |
| example 1 | 2 min | 13.85 | 45.84 | 20.98 | 66.82 |
| | 5 min | 13.80 | 45.78 | 24.74 | 70.52 |
| | 10 min | 13.79 | 45.79 | 25.02 | 70.81 |

It can be seen from Table 1 that the time of multi-arc ion discharging affects remanence, maximum magnetic energy product, intrinsic coercive force, and the sum of intrinsic coercive force and maximum magnetic energy product of the neodymium-iron-boron permanent magnet material. The longer the time of multi-arc ion discharging is, the more the values of the above parameters increase. However, as the time of multi-arc ion discharging increases to a certain degree, the values of the above parameters will not obviously increase.

Example 2 and Comparative Example 2

A method for manufacturing a permanent magnet material is as follows:

S1) magnet manufacturing step:

S1-1) smelting step: formulating the raw materials according to weight percentages as follows: 22.3% of Nd, 6.4% of Pr, 3% of Dy, 1% of B, 2% of Co, 0.2% of Cu, 0.08% of Zr, 0.15% of Ga and the balance of Fe; putting the raw materials in a vacuum rapid-hardening furnace to smelt them to manufacture an alloy sheet with an average thickness of 0.3 mm;

S1-2) powdering step: subjecting the alloy sheet obtained from the smelting step S1-1) to hydrogen absorption and dehydrogenation in a hydrogen decrepitation furnace to make the alloy sheet form coarse magnetic powder of about 300 μm; milling the coarse magnetic powder in jet milling with nitrogen as media into metal powder with an average particle size D50 of 3.8 μm;

S1-3) shaping step: applying an alignment magnetic field strength of 1.8 T to shape the fine magnetic powder obtained from the powdering step S1-2) in a moulding press under protection of nitrogen to form a green body for sintering, the green body has a density of 4.3 g/cm$^3$;

S1-4) sintering step: putting the green body obtained from the shaping step S1-3) in a vacuum sintering furnace with an absolute vacuum degree above 0.1 Pa, and sintering it at a high temperature of 1055° C. for 5 hours, to obtain a sintered neodymium-iron-boron magnet with a density of 7.62 g/cm$^3$ and a size of 50 mm×40 mm×30 mm;

S1-5) cutting process: cutting the sintered neodymium-iron-boron magnet obtained from the magnet manufacturing step S1) into magnets with a size of 38 mm×23.5 mm×2 mm;

S2) multi-arc ion plating step: fixing an alloy block material of Dy and Al on a multi-arc ion discharging device, wherein the weight percentage of Dy in the alloy block material is 80%; and placing the sintered neodymium-iron-boron magnet obtained from the cutting process S1-5) which needs infiltration in a processing chamber; the processing chamber is vacuumed to an absolute vacuum degree of 0.0005 Pa; discharging is performed by applying a voltage to the multi-arc ion discharging device, so that the alloy block material forms smoke-like microparticles during discharging; the time of applying voltage is 5 min;

S3) infiltrating step: heat treating the sintered neodymium-iron-boron magnet at different temperatures for 5 hours respectively after the multi-arc ion plating step S2); the temperatures are 900° C., 850° C., 950° C., respectively;

S4) aging treatment step: in a condition of an absolute vacuum degree above 0.01 Pa, performing the aging treatment on the sintered neodymium-iron-boron magnet obtained from the infiltrating step S3) at 510° C. for 3 hours, to obtain the neodymium-iron-boron permanent magnet material of the present invention.

Then the neodymium-iron-boron permanent magnet material obtained from the aging treatment step S4) is cut into magnets with a size of 9 mm×9 mm×2 mm and measured.

For a comparison, the aging treatment is performed on the sintered neodymium-iron-boron magnet obtained from the magnet manufacturing step S1) in vacuum at 510° C. for 3 hours; the magnet is processed into magnets with a size of 9 mm×9 mm×2 mm and measured, referred to as Comparative example 2.

Magnetic parameters of Example 2 and Comparative example 2 are shown as in Table 2.

TABLE 2

| | Conditions | $B_r$ (kGs) | $(BH)_{max}$ (MGOe) | $H_{cj}$ (kOe) | $H_{cj} + (BH)_{max}$ |
|---|---|---|---|---|---|
| comparative example 2 | Non-infiltration | 13.42 | 42.92 | 21.57 | 64.49 |
| example 2 | 850° C. | 13.45 | 42.90 | 25.88 | 68.78 |
| | 900° C. | 13.40 | 42.84 | 26.81 | 69.65 |
| | 950° C. | 13.32 | 42.24 | 24.56 | 66.8 |

It can be seen from Table 2 that the temperature of the heat treatment of the infiltrating step S2) affects remanence, maximum magnetic energy product, intrinsic coercive force, and the sum of intrinsic coercive force and maximum magnetic energy product of the neodymium-iron-boron permanent magnet material. Where the temperature of the heat treatment is either relatively low or too high, the effect of increasing the values of the above parameters will be not obvious.

Example 3 and Comparative Example 3

A method for manufacturing a permanent magnet material is as follows:

S1) magnet manufacturing step:

S1-1) smelting step: formulating the raw materials according to weight percentages as follows: 27.4% of Nd, 4.5% of Dy, 0.97% of B, 2% of Co, 0.2% of Cu, 0.08% of Zr, 0.2% of Ga, 0.3% of Al and the balance of Fe; putting the raw materials in a vacuum rapid-hardening furnace to smelt them and manufacture an alloy sheet with an average thickness of 0.3 mm;

S1-2) powdering step: subjecting the alloy sheet obtained from the smelting step S1-1) to hydrogen absorption and dehydrogenation in a hydrogen decrepitation furnace to make the alloy sheet form coarse magnetic powder of about 300 μm; milling the coarse magnetic powder in jet milling with nitrogen as media into metal powder with an average particle size D50 of 3.8 μm;

S1-3) shaping step: applying an alignment magnetic field strength of 1.8 T to shape the fine magnetic powder obtained from the powdering step S1-2) in a moulding press under protection of nitrogen to form a green body for sintering, the green body has a density of 4.3 g/cm$^3$;

S1-4) sintering step: putting the green body obtained from the shaping step S1-3) in a vacuum sintering furnace with an absolute vacuum degree above 0.1 Pa, and sintering it at a high temperature of 1055° C. for 5 hours, to obtain a sintered neodymium-iron-boron magnet with a density of 7.63 g/cm$^3$ and a size of 50 mm×40 mm×30 mm;

S1-5) cutting step: cutting the sintered neodymium-iron-boron magnet obtained from the sintering step S1-4) into magnets with a size of 38 mm×23.5 mm×2.2 mm;

S2) multi-arc ion plating step: fixing an alloy block material of Tb and Al on a multi-arc ion discharging device, wherein the weight percentage of Tb in the alloy block material is 80%; and placing the sintered neodymium-iron-boron magnet obtained from the cutting process S1-5) which needs infiltration in a processing chamber; the processing chamber is vacuumed to an absolute vacuum degree of 0.0005 Pa; discharging is performed by applying a voltage to the multi-arc ion discharging device, so that the alloy block material forms smoke-like microparticles during discharging; the time of applying voltage is 5 min;

S3) infiltrating step: heat treating the sintered neodymium-iron-boron magnet at 900° C. for 5 hours simultaneously with the multi-arc ion plating step S2);

S4) aging treatment step: in a condition of an absolute vacuum degree above 0.01 Pa, performing the aging treatment on the sintered neodymium-iron-boron magnet obtained from the infiltrating step S3) at 510° C. for 3 hours, to obtain the neodymium-iron-boron permanent magnet material of the present invention.

Then the neodymium-iron-boron permanent magnet material obtained from the aging treatment step S4) is cut into magnets with a size of 9 mm×9 mm×2 mm and measured.

For a comparison, the aging treatment is performed on the sintered neodymium-iron-boron magnet obtained from the magnet manufacturing step S1) in a condition of an absolute vacuum degree above 0.01 Pa at 510° C. for 3 hours; the magnet is processed into magnets with a size of 9 mm×9 mm×2 mm and measured, referred to as comparative example 3.

Magnetic parameters of Example 3 and Comparative example 3 are shown as in Table 3.

TABLE 3

| | Conditions | $B_r$ (kGs) | $(BH)_{max}$ (MGOe) | $H_{cj}$ (kOe) | $H_{cj}$ + $BH_{max}$ |
|---|---|---|---|---|---|
| comparative example 3 | Non-infiltration | 12.95 | 40.37 | 25.53 | 65.9 |
| example 3 | 900° C. | 12.89 | 39.98 | 32.41 | 72.39 |

It can be seen from Table 3 that comparing example 3 in which the multi-arc ion plating step and the infiltrating step have been carried out with comparative example 3 in which the multi-arc ion plating step and the infiltrating step have not been carried out, remanence and maximum magnetic energy product of example 3 decrease a little, but both of intrinsic coercive force and the sum of intrinsic coercive force and maximum magnetic energy product of example 3 increase obviously.

It can be seen from the effects of the above examples that the present invention adopts a multi-arc ion plating process to deposit the metal containing a heavy rare earth element on the surface of the sintered neodymium-iron-boron magnet; the heavy rare earth element is melt and infiltrated to the intergranular phase in the sintered neodymium-iron-boron magnet through heat treatment; and then a neodymium-iron-boron permanent magnet material is manufactured through aging treatment. The neodymium-iron-boron permanent magnet material obtained by the manufacturing method of the present invention has a sum of an intrinsic coercive force ($H_{cj}$, in unit of kOe) and a maximum magnetic energy product ($(BH)_{max}$, in unit of MGOe) of 66.8 or more. Moreover, because the multi-arc ion plating process is adopted, the manufacturing method of the present invention has high production efficiency and does not increase harmful substances, and the price of devices is relatively low.

The present invention is not limited by the above embodiments. All variations, modifications and replacements to the disclosed embodiments which are apparent to those skilled in the art and do not depart from the essence of the present invention fall in the scope of the present invention.

What is claimed is:

1. A method for manufacturing a rare earth permanent magnet material, comprising steps as follows:

S1) magnet manufacturing step:

S1-1) smelting step: formulating raw materials consisting of the following ingredients with weight percentages: 27.4% of Nd, 4.5% of Dy, 0.97% of B, 2% of Co, 0.2% of Cu, 0.08% of Zr, 0.2% of Ga, 0.3% of Al and the balance of Fe; putting the raw materials in a vacuum rapid-hardening furnace to smelt them and manufacture an alloy sheet with an average thickness of 0.3 mm;

S1-2) powdering step: subjecting the alloy sheet obtained from the smelting step S1-1) to hydrogen absorption and dehydrogenation in a hydrogen decrepitation furnace to make coarse magnetic powder of about 300 μm; milling the coarse magnetic powder by jet milling with nitrogen as media into fine magnetic powder with an average particle size D50 of 3.8 μm;

S1-3) shaping step: applying an alignment magnetic field strength of 1.8T to shape the fine magnetic powder obtained from the powdering step S1-2) in a moulding press under protection of nitrogen to form a green body with a density of 4.3 g/cm3;

S1-4) sintering step: putting the green body obtained from the shaping step S1-3) in a vacuum sintering furnace with an absolute vacuum degree above 0.1 Pa, and sintering it at a high temperature of 1055° C. for 5 hours, to obtain a sintered neodymium-iron-boron magnet with a density of 7.63 g/cm3 and a size of 50 mm×40 mm×30 mm; and S1-5) cutting step: cutting the sintered neodymium-iron-boron magnet obtained from the sintering step S1-4) into magnets with a size of 38 mm×23.5 mm×2.2 mm;

S2) multi-arc ion plating step: fixing an alloy block material of Tb and Al as a cathode material on a multi-arc ion discharging device, wherein the weight percentage of Tb in the alloy block material is 80%; placing the magnets obtained from the cutting process S1-5) in a processing chamber; evacuating the processing chamber to an absolute vacuum degree of 0.0005 Pa; applying a voltage to the multi-arc ion discharging device for 5 minutes to perform discharging, leading to evaporation and ionization of the cathode material, so that the alloy block material forms smoke-like microparticles during discharging; depositing the smoke-like microparticles on a surface of the magnets;

S3) infiltrating step: heat treating the magnets at 900° C. for 5 hours simultaneously with the multi-arc ion plating step S2); and S4) aging treatment step: in a condition of an absolute vacuum degree above 0.01 Pa, performing aging treatment on the magnets obtained from the infiltrating step S3) at 510° C. for 3 hours to obtain the rare earth permanent magnet material.

* * * * *